US011209014B2

(12) United States Patent
Lin et al.

(10) Patent No.: US 11,209,014 B2
(45) Date of Patent: Dec. 28, 2021

(54) AXIAL FLOW FAN

(71) Applicant: Acer Incorporated, New Taipei (TW)

(72) Inventors: Kuang-Hua Lin, New Taipei (TW); Tsung-Ting Chen, New Taipei (TW); Cheng-Wen Hsieh, New Taipei (TW); Wen-Neng Liao, New Taipei (TW)

(73) Assignee: Acer Incorporated, New Taipei (TW)

( * ) Notice: Subject to any disclaimer, the term of this patent is extended or adjusted under 35 U.S.C. 154(b) by 59 days.

(21) Appl. No.: 16/795,603

(22) Filed: Feb. 20, 2020

(65) Prior Publication Data

US 2021/0079927 A1 Mar. 18, 2021

(30) Foreign Application Priority Data

Sep. 18, 2019 (TW) ..... 108133703

(51) Int. Cl.
*F04D 29/32* (2006.01)
*F04D 29/38* (2006.01)
*F04D 29/66* (2006.01)

(52) U.S. Cl.
CPC ..... *F04D 29/384* (2013.01); *F04D 29/666* (2013.01); *F05B 2240/301* (2013.01); *F05B 2260/96* (2013.01)

(58) Field of Classification Search
CPC .... F04D 29/327; F04D 29/384; F04D 29/388; F04D 29/666; F05B 2240/301; F05B 2260/96; F05D 2240/305; F05D 2240/306
See application file for complete search history.

(56) References Cited

U.S. PATENT DOCUMENTS 1,021,822 A * 4/1912 Broussouse ..... B63H 1/14 416/200 R
1,779,026 A * 10/1930 Wragg ..... B63H 1/26 416/196 R
4,512,718 A * 4/1985 Stargardter ..... F01D 5/142 416/231 B
7,025,569 B2 * 4/2006 Chang ..... F04D 29/38 416/183

(Continued)

FOREIGN PATENT DOCUMENTS

| | | |
|---|---|---|
| CA | 1198681 | 12/1985 |
| TW | M476187 | 4/2014 |
| TW | I464328 | 12/2014 |

OTHER PUBLICATIONS

"Search Report of Europe Counterpart Application", dated Sep. 14, 2020, p. 1-p. 6.

*Primary Examiner* — Ninh H. Nguyen
(74) *Attorney, Agent, or Firm* — JCIPRNET

(57) ABSTRACT

An axial flow fan includes a hub and a plurality of fan sets disposed around the hub. The hub rotates around a center axis and has a positive pressure side and a negative pressure side opposite to each other. Each of the fan sets includes at least two blades, and each blade has a wind inlet end, a wind outlet end opposite to the wind inlet end, a negative pressure surface, and a positive pressure surface opposite to the negative pressure surface. The wind outlet end of one of the adjacent two blades corresponds to the wind inlet end of the other one of the adjacent two blades. A gap is provided between the negative pressure surface of one of the adjacent two blades and the positive pressure surface of the other one of the adjacent two blades.

16 Claims, 7 Drawing Sheets

(56) References Cited

U.S. PATENT DOCUMENTS

| | | | | |
|---|---|---|---|---|
| 10,036,392 | B2 * | 7/2018 | Gallina | F04D 19/002 |
| 2007/0154314 | A1 * | 7/2007 | Jarrah | F04D 29/327 416/203 |
| 2014/0233178 | A1 | 8/2014 | Franz | |
| 2015/0152879 | A1 | 6/2015 | Tzeng | |

* cited by examiner

AXIAL FLOW FAN

CROSS-REFERENCE TO RELATED APPLICATION

This application claims the priority benefit of Taiwan application serial no. 108133703, filed on Sep. 18, 2019. The entirety of the above-mentioned patent application is hereby incorporated by reference herein and made a part of this specification.

BACKGROUND

Technical Field

The disclosure relates to a fan, and more particularly, relates to an axial flow fan.

Description of Related Art

In an existing axial flow fan, cross sections of the blades are designed to be airfoil-shaped, and such design relates to generation of a separation flow. When the axial flow fan generates a separation flow, the separation flow may cause the axial flow fan to stall, which in turn causes the axial flow fan to idle, and the axial flow fan is prevented from driving the air as a result. Performance of heat dissipation is thereby decreased. In addition, disturbances in the airflow are also generated, and as such, disturbing noise is caused. Therefore, how to reduce generation of a separation flow in an axial flow fan is an important issue.

SUMMARY

The disclosure provides an axial flow fan in which the problem of idling found in an existing axial flow fan caused by easy generation of a separation flow is solved.

In an embodiment of the disclosure, an axial flow fan includes a hub and a plurality of fan sets. The hub is configured to rotate around a center axis and has a positive pressure side and a negative pressure side opposite to each other. The fan sets are disposed around the hub. Each of the fan sets includes at least two blades. In each of the fan sets, each of the blades has a wind inlet end, a wind outlet end opposite to the wind inlet end, a negative pressure surface, and a positive pressure surface opposite to the negative pressure surface. A minimum distance between the wind inlet end of one of the adjacent at least two blades and the positive pressure side is greater than a minimum distance between the wind inlet end of the other one of the adjacent at least two blades and the positive pressure side. A minimum distance between the wind outlet end of one of the adjacent at least two blades and the negative pressure side is less than a minimum distance between the wind outlet end of the other one of the adjacent at least two blades and the negative pressure side. The wind outlet end of one of the adjacent at least two blades corresponds to the wind inlet end of the other one of the adjacent at least two blades. The negative pressure surface of one of the adjacent at least two blades corresponds to the positive pressure surface of the other one of the adjacent at least two blades. A gap is provided between the negative pressure surface of one of the adjacent at least two blades and the positive pressure surface of the other one of the adjacent at least two blades.

In an embodiment of the disclosure, the wind inlet end is connected between the positive pressure surface and the negative pressure surface in each of the fan sets. The wind outlet end of each of the at least two blades is connected between the positive pressure surface and the negative pressure surface. The negative pressure surface of each of the at least two blades is relatively close to the negative pressure side. The positive pressure surface of each of the at least two blades is relatively close to the positive pressure side. The minimum distance between the wind inlet end of each of the at least two blades and the positive pressure side is greater than a minimum distance between the wind outlet end of each of the at least two blades and the positive pressure side.

In an embodiment of the disclosure, in each of the fan sets, a curvature of the negative pressure surface of one of the adjacent at least two blades is greater than a curvature of the negative pressure surface of the other one of the adjacent at least two blades.

In an embodiment of the disclosure, in each of the fan sets, curvatures of the negative pressure surfaces of the at least two blades are different from each other.

In an embodiment of the disclosure, in each of the fan sets, curvatures of the negative pressure surfaces of the at least two blades decrease as the distances between wind inlet ends of the at least two blades and the positive pressure side decrease.

In an embodiment of the disclosure, a material of the at least two blades includes metal.

In an embodiment of the disclosure, each of the at least two blades has a uniform thickness or a non-uniform thickness.

In an embodiment of the disclosure, in each of the fan sets, orthographic projection of the at least two blades on any plane perpendicular to the center axis do not overlap with each other.

In an embodiment of the disclosure, in each of the fan sets, a tangent line is defined by a limit of the negative pressure surface of one of the adjacent at least two blades close to the wind inlet end. The other tangent line is defined by a limit of the negative pressure surface of the other one of the at least two blades. A slope of the other tangent line is greater than a slope of the tangent line.

In an embodiment of the disclosure, in each of the fan sets, a first tangent line is defined by a limit of the negative pressure surface of each of the at least two blades close to the wind inlet end. A second tangent line is defined by a limit of the negative pressure surface of each of the at least two blades close to the wind outlet end. A slope of the second tangent line is greater than a slope of the first tangent line.

In an embodiment of the disclosure, the hub rotates around the center axis in a first direction. Each of the at least two blades is bent in a second direction. The first direction is opposite to the second direction.

In an embodiment of the disclosure, in each of the fan sets, the at least two blades are arranged in the second direction from one of the adjacent at least two blades to the other one of the adjacent at least two blades.

In an embodiment of the disclosure, an area of orthographic projection of the other one of the adjacent at least two blades on any plane perpendicular to the center axis is greater than an area of orthographic projection of one of the adjacent at least two blades on any plane perpendicular to the center axis.

In an embodiment of the disclosure, each of the fan sets includes a first blade, a second blade, and a third blade. The first blade is connected to the hub and has a first wind inlet end, a first negative pressure surface, a first wind outlet end, and a first positive pressure surface connected in sequence. The second blade is connected to the hub and has a second wind inlet end, a second negative pressure surface, a second wind outlet end, and a second positive pressure surface connected in sequence. The third blade is connected to the hub and has a third wind inlet end, a third negative pressure surface, a third wind outlet end, and a third positive pressure surface connected in sequence. A first minimum distance between the first wind inlet end and the positive pressure side is greater than a second minimum distance between the second wind inlet end and the positive pressure side. The second minimum distance between the second wind inlet end and the positive pressure side is greater than a third minimum distance between the third wind inlet end and the positive pressure side. A fourth minimum distance between the first wind outlet end and the negative pressure side is less than a fifth minimum distance between the second wind outlet end and the negative pressure side. The fifth minimum distance between the second wind outlet end and the negative pressure side is less than a sixth minimum distance between the third wind outlet end and the negative pressure side. The first wind outlet end corresponds to the second wind inlet end. The second wind outlet end corresponds to the third wind inlet end. The first negative pressure surface corresponds to the second positive pressure surface, and a first gap is provided between the first negative pressure surface and the second positive pressure surface. The second negative pressure surface corresponds to the third positive pressure surface, and a second gap is provided between the second negative pressure surface and the third positive pressure surface.

In an embodiment of the disclosure, the first negative pressure surface, the second negative pressure surface, and the third negative pressure surface are relatively close to the negative pressure side. The first positive pressure surface, the second positive pressure surface, and the third positive pressure surface are relatively close to the positive pressure side. The first minimum distance between the first wind inlet end and the positive pressure side is greater than a seventh minimum distance between the first wind outlet end and the positive pressure side. The second minimum distance between the second wind inlet end and the positive pressure side is greater than an eighth minimum distance between the second wind outlet end and the positive pressure side. The third minimum distance between the third wind inlet end and the positive pressure side is greater than a ninth minimum distance between the third wind outlet end and the positive pressure side.

In an embodiment of the disclosure, a center plane is defined at a middle of the negative pressure side and the positive pressure side of the hub. The first blade is close to the negative pressure side. The second blade crosses the center plane. The third blade is close to the positive pressure side.

In an embodiment of the disclosure, a first negative pressure point is defined at connection between the first wind inlet end and the first negative pressure surface. A second negative pressure point is defined at connection between the second wind inlet end and the second negative pressure surface. A third negative pressure point is defined at connection between the third wind inlet end and the third negative pressure surface. A fourth negative pressure point is defined at connection between the third wind outlet end and the third negative pressure surface. A first positive pressure point is defined at connection between the first wind inlet end and the first positive pressure surface. A second positive pressure point is defined at connection between the first wind outlet end and the first positive pressure surface. A third positive pressure point is defined at connection between the second wind outlet end and the second positive pressure surface. A fourth positive pressure point is defined at connection between the third wind outlet end and the third positive pressure surface. A first connection line is defined among the first negative pressure point, the second negative pressure point, the third negative pressure point, and the fourth negative pressure point. A second connection line is defined between the fourth negative pressure point and the fourth positive pressure point. A third connection line is defined among the first positive pressure point, the second positive pressure point, the third positive pressure point, and the fourth positive pressure point. A fourth connection line is defined between the first negative pressure point and the first positive pressure point. An airfoil is surrounded and formed by the first connection line, the second connection line, the third connection line, and the fourth connection line.

Based on the above, in the axial flow fan provided by the disclosure, possibility of generation of a separation flow is reduced, and the effect of noise reduction is achieved.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1A:
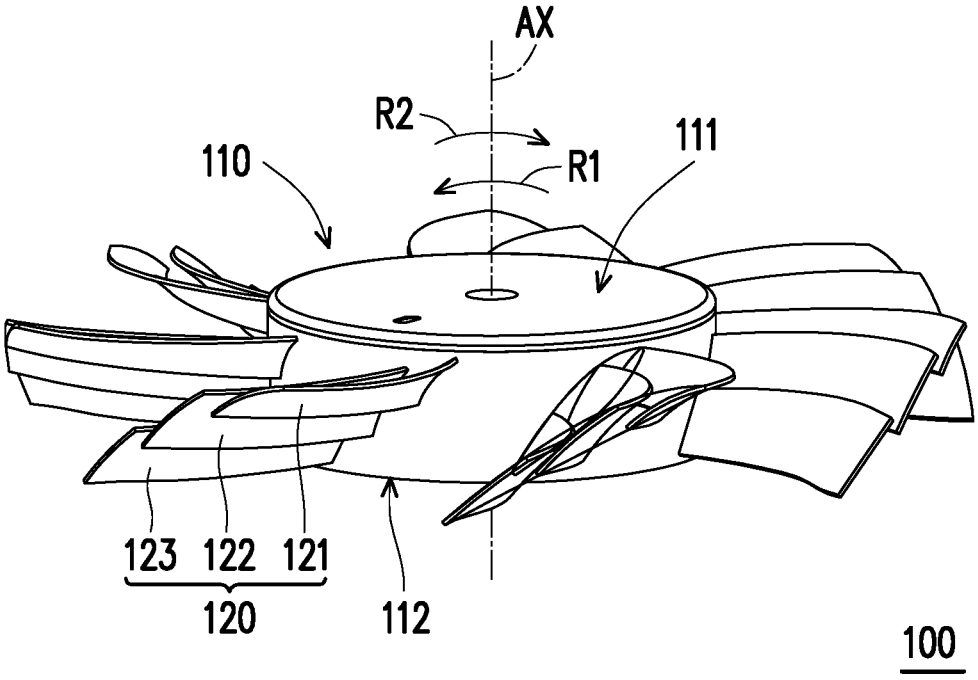
FIG. 1A is a schematic three-dimensional view of an axial flow fan according to an embodiment of the disclosure.
Figure 1B:
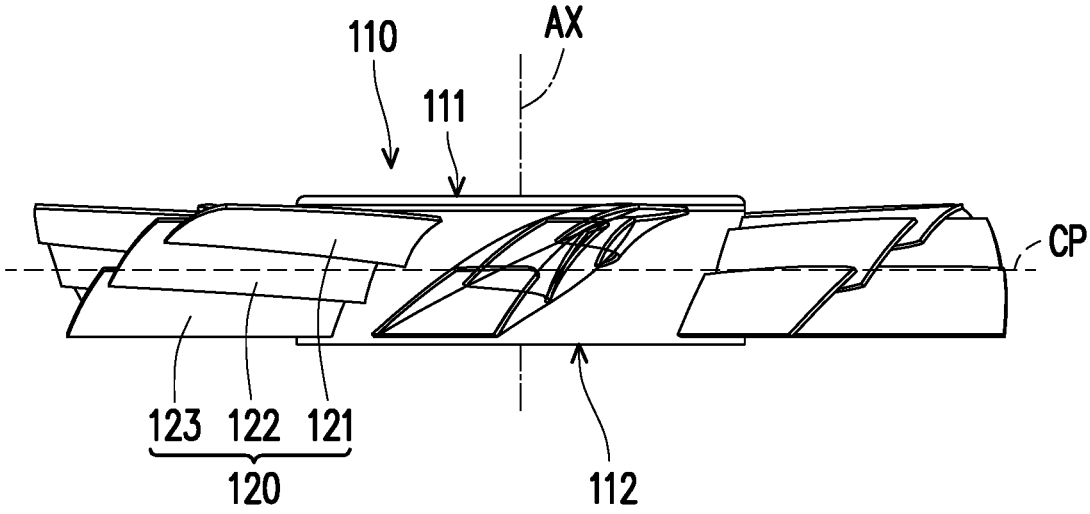
FIG. 1B is a schematic side view of the axial flow fan of FIG. 1A.
Figure 1C:
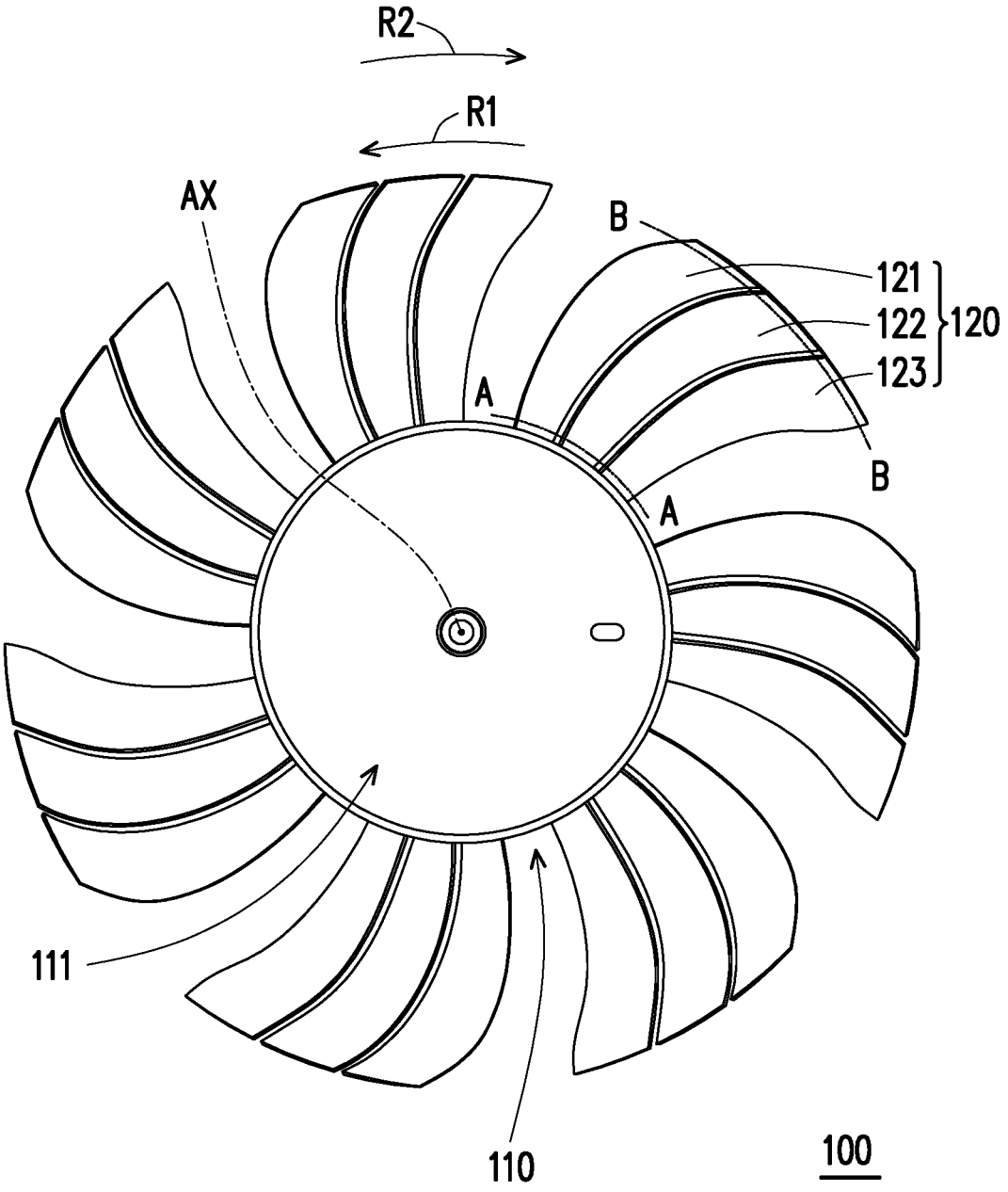
FIG. 1C is a schematic top view of the axial flow fan of FIG. 1A.

FIG. 1A is a schematic three-dimensional view of an axial flow fan according to an embodiment of the disclosure. FIG. 1B is a schematic side view of the axial flow fan of FIG. 1A. FIG. 1C is a schematic top view of the axial flow fan of FIG. 1A. With reference to FIG. 1A, FIG. 1B, and FIG. 1C, an axial flow fan 100 of this embodiment includes a hub 110 and a plurality of fan sets 120. The hub 110 is configured to rotate around a center axis AX and has a negative pressure side 111 and a positive pressure side 112 opposite to the negative pressure side 111. The plurality of fan sets 120 surround the hub 110, and each of the fan sets 120 is connected to the hub 110. In order to allow the description to be concise, only one set of the fan sets 120 is described below.

Specifically, the fan set 120 includes a first blade 121, a second blade 122, and a third blade 123, and all of these blades are connected to the hub 110. A center plane CP is defined at a middle of the negative pressure side 111 and the positive pressure side 112 of the hub 110. The first blade 121 is relatively close to the negative pressure side 111. The second blade 122 crosses the center plane CP. The third blade 123 is relatively close to the positive pressure side 112.

Certainly, positions of the first blade 121, the second blade 122, and the third blade 123 are not limited in this embodiment. For instance, the first blade 121, the second blade 122, and the third blade 123 may all be disposed to be close to the negative pressure side 111, may all be disposed to be close to the positive pressure side 112, or may all be disposed to cross the center plane CP according to needs.

In addition, a number of the blades included in the fan set 120 is not limited in this embodiment. For instance, the fan set 120 may have at least two blades. Arrangement of the blades is not limited either and can be determined according to needs.

Figure 2A:
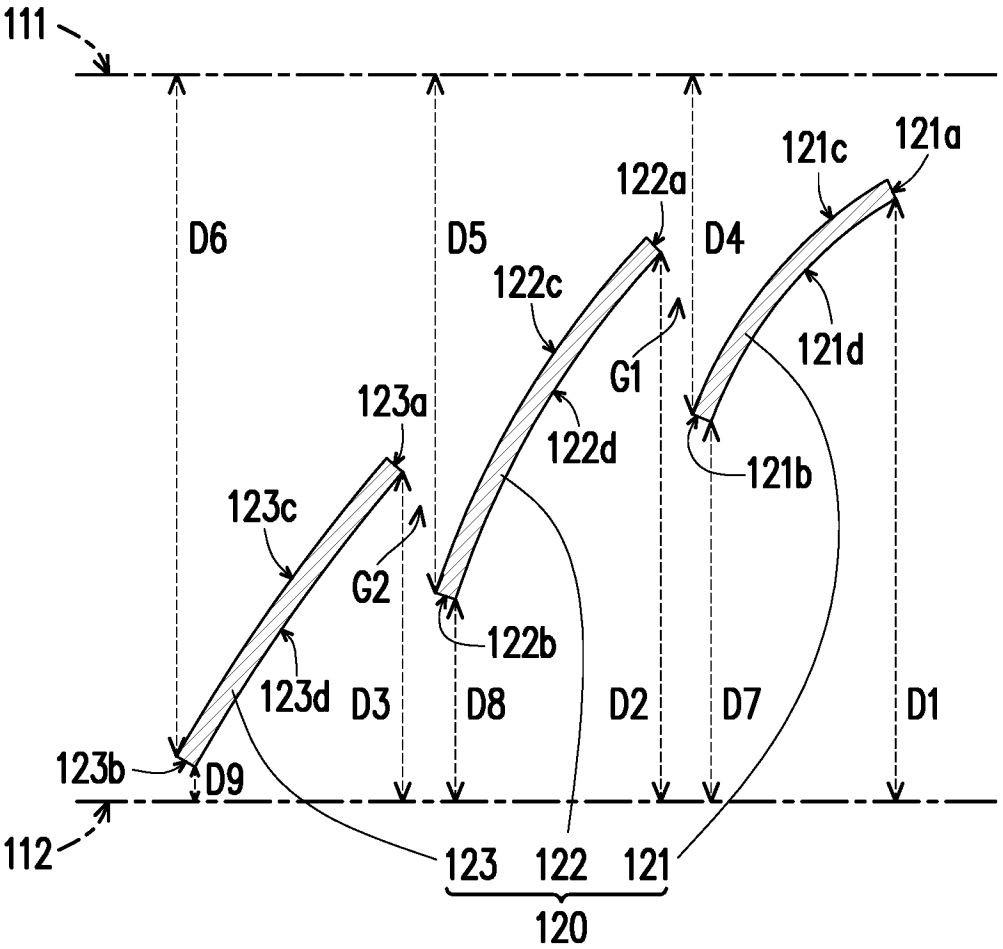
FIG. 2A and FIG. 2B are schematic cross-sectional views of FIG. 1C taken along a cutting line A-A.
Figure 2B:
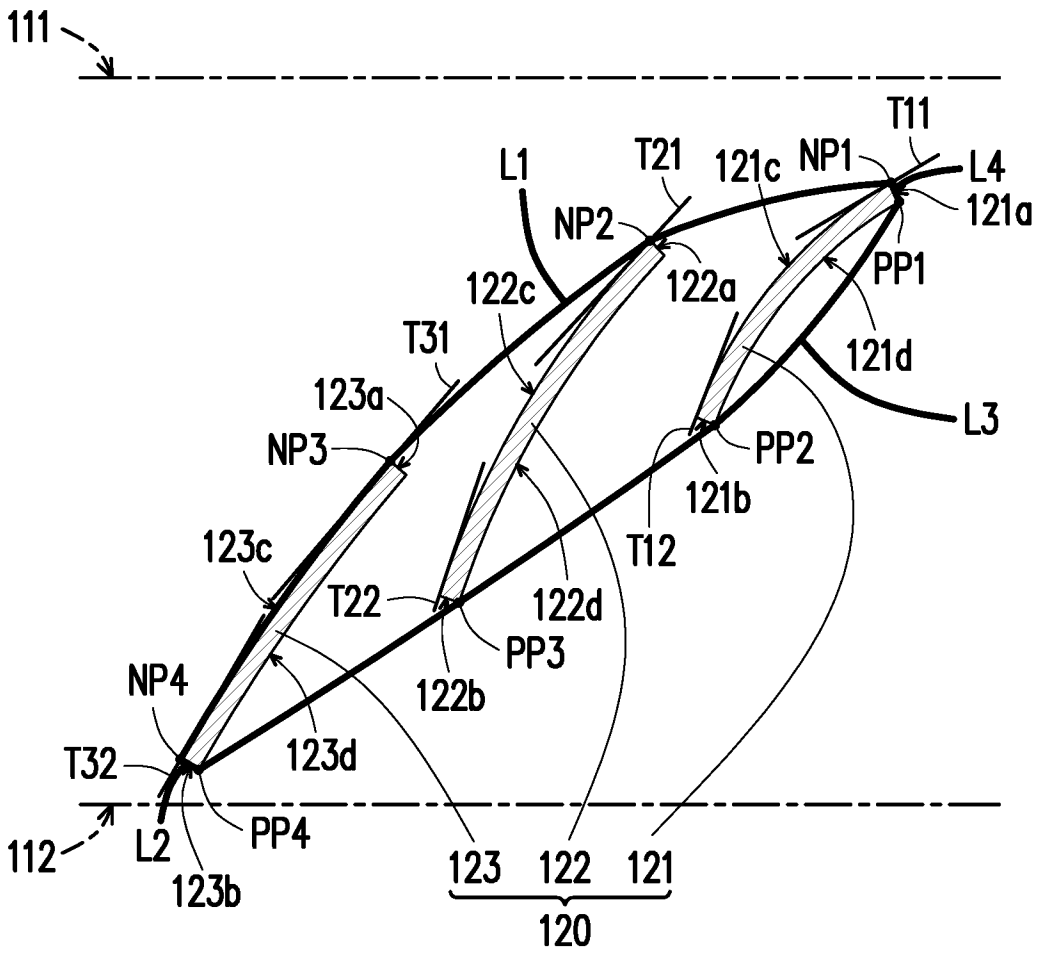
Figure 3A:
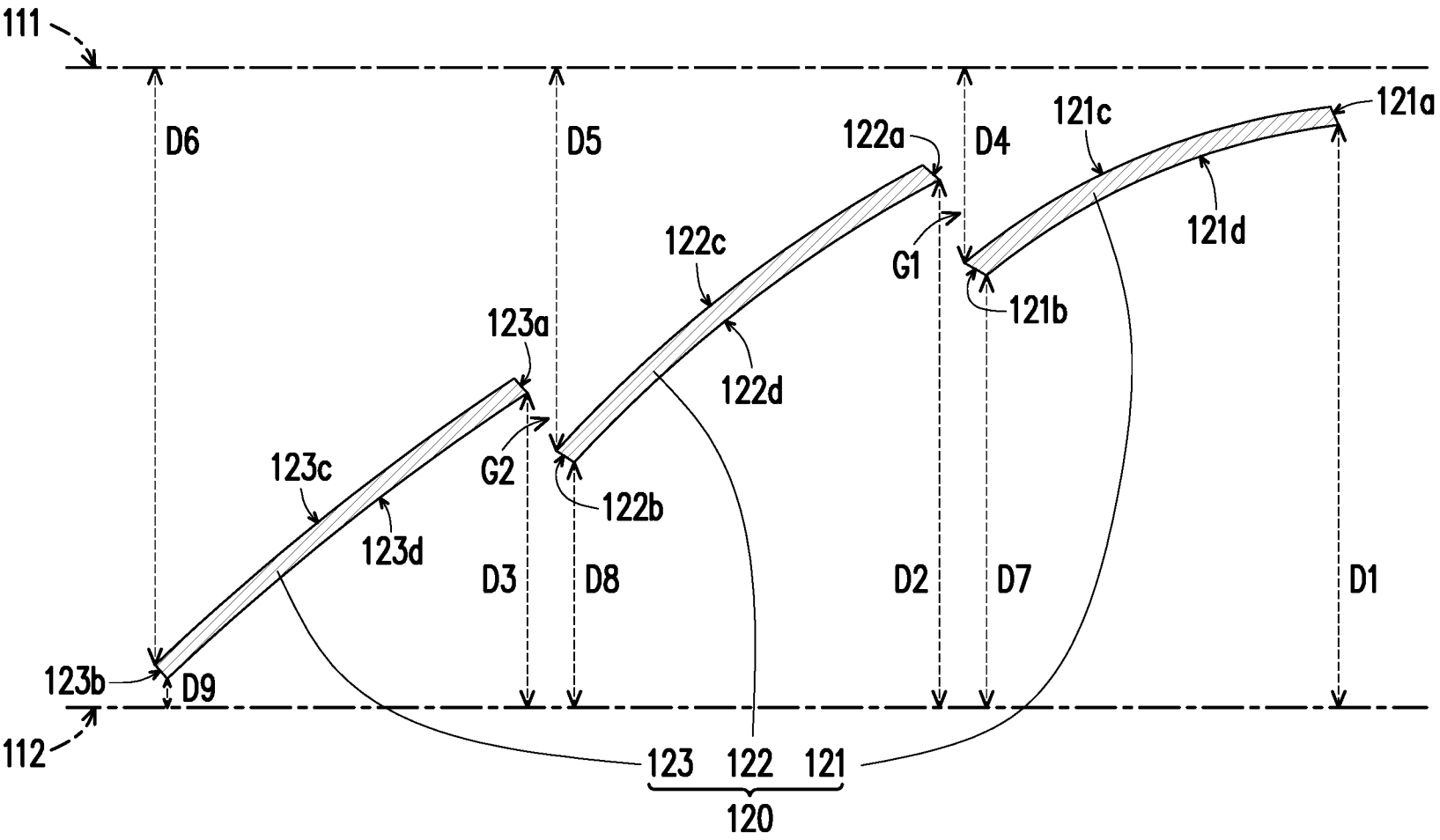
FIG. 3A and FIG. 3B are schematic cross-sectional views of FIG. 1C taken along a cutting line B-B.
Figure 3B:
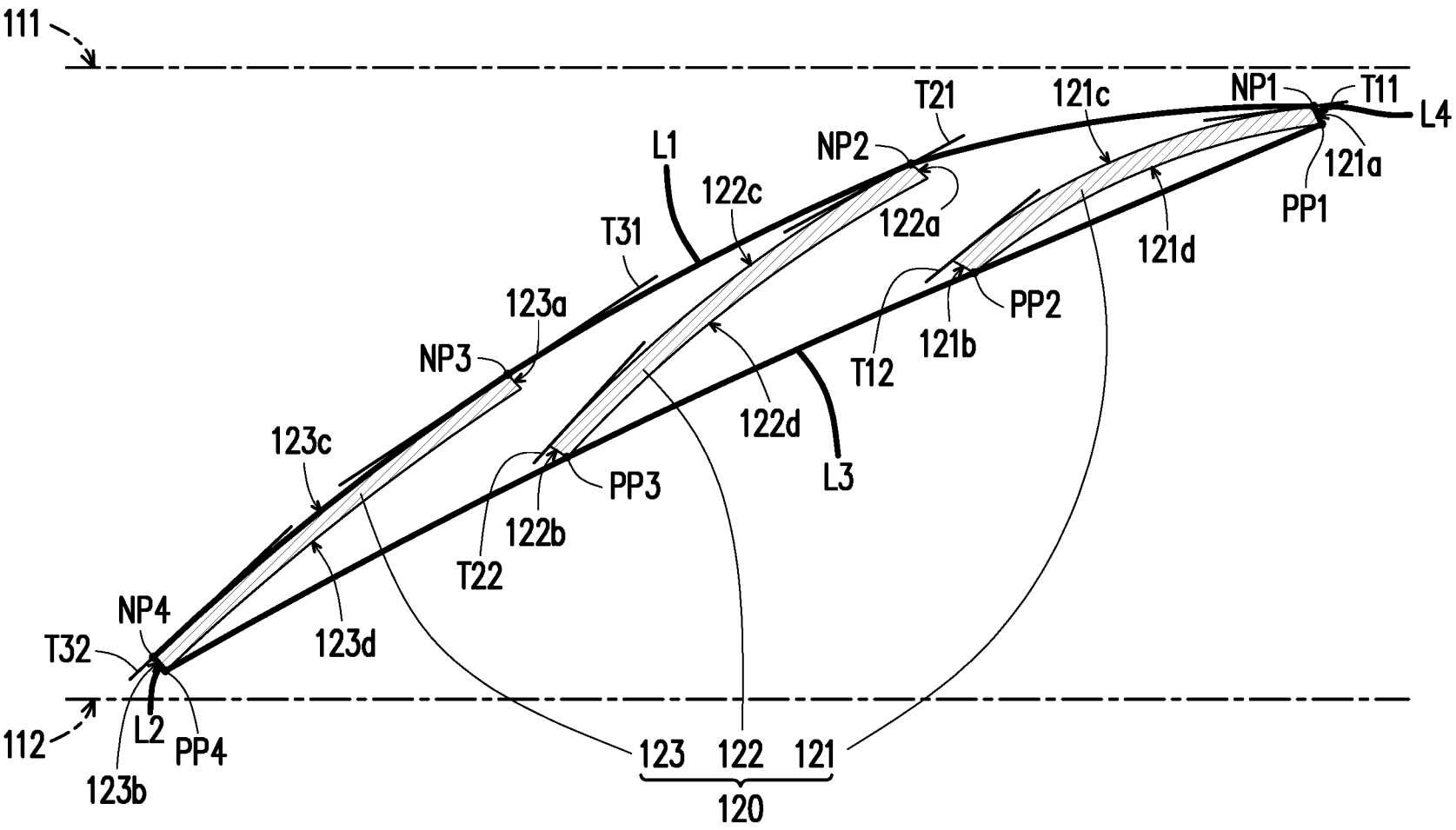

FIG. 2A and FIG. 2B are schematic cross-sectional views of FIG. 1C taken along a cutting line A-A. FIG. 3A and FIG. 3B are schematic cross-sectional views of FIG. 1C taken along a cutting line B-B. With reference to FIG. 1A, FIG. 1C, FIG. 2A, and FIG. 3A, the first blade 121 has a first wind inlet end 121*a*, a first negative pressure surface 121*c*, a first wind outlet end 121*b*, and a first positive pressure surface 121*d* connected in sequence. The first wind outlet end 121*b* is opposite to the first wind inlet end 121*a*, and the first positive pressure surface 121*d* is opposite to the first negative pressure surface 121*c*. A first minimum distance D1 is provided between the first wind inlet end 121*a* and the positive pressure side 112. A fourth minimum distance D4 is provided between the first wind outlet end 121*b* and the negative pressure side 111. A seventh minimum distance D7 is provided between the first wind outlet end 121*b* and the positive pressure side 112.

Further, the second blade 122 has a second wind inlet end 122*a*, a second negative pressure surface 122*c*, a second wind outlet end 122*b*, and a second positive pressure surface 122*d* connected in sequence. The second wind outlet end 122*b* is opposite to the second wind inlet end 122*a*, and the second positive pressure surface 122*d* is opposite to the second negative pressure surface 122*c*. A second minimum distance D2 is provided between the second wind inlet end 122*a* and the positive pressure side 112. A fifth minimum distance D5 is provided between the second wind outlet end 122*b* and the negative pressure side 111. An eighth minimum distance D8 is provided between the second wind outlet end 122*b* and the positive pressure side 112.

Moreover, the third blade 123 has a third wind inlet end 123*a*, a third negative pressure surface 123*c*, a third wind outlet end 123*b*, and a third positive pressure surface 123*d* connected in sequence. The third wind outlet end 123*b* is opposite to the third wind inlet end 123*a*, and the third positive pressure surface 123*d* is opposite to the third negative pressure surface 123*c*. A third minimum distance D3 is provided between the third wind inlet end 123*a* and the positive pressure side 112. A sixth minimum distance D6 is provided between the third wind outlet end 123*b* and the negative pressure side 111. A ninth minimum distance D9 is provided between the third wind outlet end 123*b* and the positive pressure side 112.

In this embodiment, the first minimum distance D1 is greater than the second minimum distance D2, and the second minimum distance D2 is greater than the third minimum distance D3. The sixth minimum distance D6 is greater than the fifth minimum distance D5, and the fifth minimum distance D5 is greater than the fourth minimum distance D4. That is, D1>D2>D3 and D6>D5>D4. The first minimum distance D1 is greater than the seventh minimum distance D7, the second minimum distance D2 is greater than the eighth minimum distance D8, and the third minimum distance D3 is greater than the ninth minimum distance D9. That is, D1>D7, D2>D8, and D3>D9.

With reference to FIG. 1A, FIG. 1C, FIG. 2A, and FIG. 3A, the first negative pressure surface 121*c*, the second negative pressure surface 122*c*, and the third negative pressure surface 123*c* all refer to surfaces relatively close to the negative pressure side 111. The first positive pressure surface 121*d*, the second positive pressure surface 122*d*, and the third positive pressure surface 123*d* all refer to surfaces relatively close to the positive pressure side 112.

In this embodiment, the first wind outlet end 121*b* corresponds to the second wind inlet end 122*a*, and the second wind outlet end 122*b* corresponds to the third wind inlet end 123*a*. The first negative pressure surface 121*c* corresponds to the second positive pressure surface 122*d*, and a first gap G1 is provided between the first negative pressure surface 121*c* and the second positive pressure surface 122*d*. The second negative pressure surface 122*c* corresponds to the third positive pressure surface 123*d*, and a second gap G2 is provided between the second negative pressure surface 122*c* and the third positive pressure surface 123*d*.

Through the arrangement provided above, an airflow may pass through the first negative pressure surface 121*c*, the second positive pressure surface 122*d*, and the positive pressure side 112 in sequence from the negative pressure side 111, so that possibility of generation of a separation flow at the first negative pressure surface 121*c* is accordingly reduced, and noise may also be lowered. Further, the airflow may pass through the second negative pressure surface 122*c*, the third positive pressure surface 123*d*, and the positive pressure side 112 in sequence from the negative pressure side 111, so that possibility of generation of a separation flow at the second negative pressure surface 122*c* is accordingly reduced, and noise may also be lowered.

With reference to FIG. 2A and FIG. 3A, the first negative pressure surface 121*c*, the second negative pressure surface 122*c*, and the third negative pressure surface 123*c* are curved surfaces, and a curvature of the first negative pressure surface 121*c*, a curvature of the second negative pressure surface 122*c*, and a curvature of the third negative pressure surface 123*c* are all different.

For instance, the curvature of the first negative pressure surface 121*c* is greater than the curvature of the second negative pressure surface 122*c*, and the curvature of the second negative pressure surface 122*c* is greater than the curvature of the third negative pressure surface 123*c*. In other words, among the plurality of blades in each of the fan sets 120, the curvature of the blade closer to the positive pressure side 112 is lower. In contrast, the curvature of the blade closer to the negative pressure side 111 is greater.

With reference to FIG. 1A, FIG. 2B, and FIG. 3B, a first negative pressure point NP1 is defined at connection between the first wind inlet end 121*a* and the first negative pressure surface 121*c*. A second negative pressure point NP2 is defined at connection between the second wind inlet end 122*a* and the second negative pressure surface 122*c*. A third negative pressure point NP3 is defined at connection between the third wind inlet end 123*a* and the third negative pressure surface 123*c*. A fourth negative pressure point NP4 is defined at connection between the third wind outlet end 123*b* and the third negative pressure surface 123*c*. A first connection line L1 is defined among the first negative pressure point NP1, the second negative pressure point NP2, the third negative pressure point NP3, and the fourth negative pressure point NP4.

In another aspect, a first positive pressure point PP1 is defined at connection between the first wind inlet end 121*a* and the first positive pressure surface 121*d*. A second positive pressure point PP2 is defined at connection between the first wind outlet end 121*b* and the first positive pressure surface 121*d*. A third positive pressure point PP3 is defined at connection between the second wind outlet end 122*b* and the second positive pressure surface 122*d*. A fourth positive pressure point PP4 is defined at connection between the third wind outlet end 123*b* and the third positive pressure surface 123*d*. A third connection line L3 is defined among the first positive pressure point PP1, the second positive pressure point PP2, the third positive pressure point PP3, and the fourth positive pressure point PP4.

Besides, a second connection line L2 is defined between the fourth negative pressure point NP4 and the fourth positive pressure point PP4, and a fourth connection line L4 is defined between the first negative pressure point NP1 and the first positive pressure point PP 1. An airfoil is surrounded and formed by the first connection line L1, the second connection line L2, the third connection line L3, and the fourth connection line L4. The airfoil design of the fan sets 120 provided by this embodiment may be used to replace the single-blade design provided by a conventional axial flow fan, and in this way, generation of a separation flow in the axial flow fan may be reduced, so that the axial flow fan 100 is prevented from stalling during rotation.

With reference to FIG. 1A, FIG. 2B, and FIG. 3B, a first tangent line T11 is defined by a limit of the first negative pressure surface 121*c* of the first blade 121 close to the first wind inlet end 121*a*, and a first tangent line T12 is defined by a limit of the first negative pressure surface 121*c* close to the first wind outlet end 121*b*. A second tangent line T21 is defined by a limit of the negative pressure surface 122*c* close to the second wind inlet end and 122*a*, and a second tangent line T22 is defined by a limit of the second negative pressure surface 122*c* close to the second wind outlet end 122*b*. A third tangent line T31 is defined by a limit of the third negative pressure surface 123*c* close to the third wind inlet end 123*a*, and a third tangent line T32 is defined by a limit of the third negative pressure surface 123*c* close to the third wind outlet end 123*b*.

In this embodiment, a slope of the first tangent line T12 is greater than a slope of the first tangent line T11, a slope of the second tangent line T22 is greater than a slope of the second tangent line T21, and a slope of the third tangent line T32 is greater than a slope of the third tangent line T31. In addition, the slope of the first tangent line T11 is greater than the slope of the second tangent line T21, and the slope of the second tangent line T21 is greater than the slope of the third tangent line T31.

In this embodiment, a material of the first blade 121, the second blade 122, and the third blade 123 includes metal. Moreover, each of the first blade 121, the second blade 122, and the third blade 123 may be manufactured through pressing and has a uniform thickness.

In other embodiments, the material of the first blade 121, the second blade 122, and the third blade 123 may be a general plastic material, and each of the first blade 121, the second blade 122, and the third blade 123 may have a non-uniform thickness depending on needs.

With reference to FIG. 1A, FIG. 1B, and FIG. 1C, in this embodiment, the hub 110 rotates in a first direction R1 (e.g., a clockwise direction) around the center axis AX, and the first blade 121, the second blade 122, and the third blade 123 are bent in a second direction R2 (e.g., a counter-clockwise direction) and thus are swept-back shaped. The first blade 121, the second blade 122, and the third blade 123 are arranged in the second direction R2 in sequence.

Figure 4:
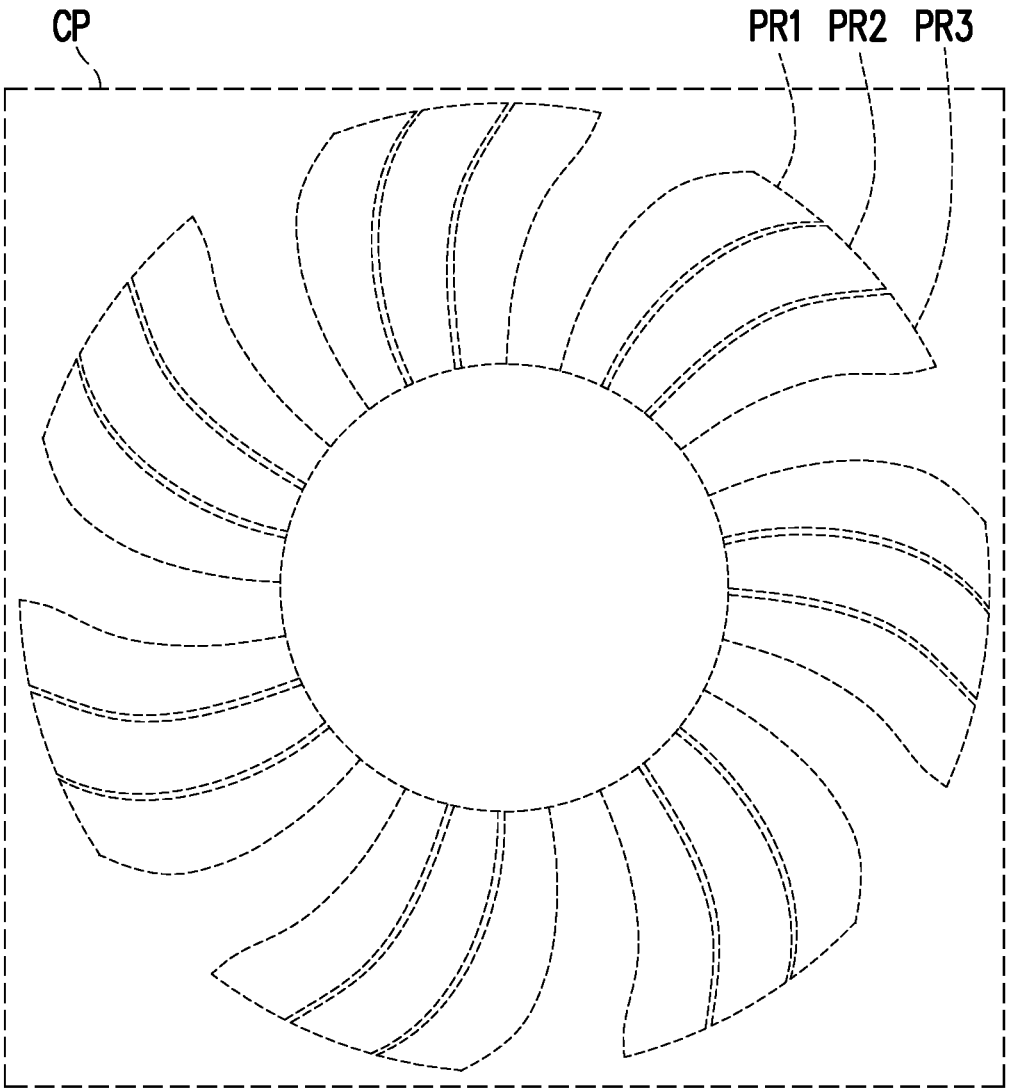
FIG. 4 is a schematic view of orthographic projection of each of the blades of the fan sets of FIG. 1C on a center plane.

FIG. 4 is a schematic view of orthographic projection of each of the blades of the fan sets of FIG. 1C on a center plane. With reference to FIG. 1B, FIG. 1C, and FIG. 4, the first blade 121 has first orthographic projection PR1 on the center plane CP. The second blade 122 has second orthographic projection PR2 on the center plane CP. The third blade 123 has third orthographic projection PR3 on the center plane CP. The first orthographic projection PR1, the second orthographic projection PR2, and the third orthographic projection PR3 do not overlap.

In this embodiment, an area of the third orthographic projection PR3 is greater than an area of the second orthographic projection PR2, and the area of the second orthographic projection PR2 is greater than an area of the first orthographic projection PR1. In other words, in the swept-back fan set 120 of this embodiment, the area of the orthographic projection on the center plane CP of the blade arranged in the back in the second direction R2 is greater than the area of the orthographic projection on the center plane CP of the blade arranged at the front in the second direction R2.

In the embodiments that are not shown, the first blade, the second blade, and the third blade may also be bent in the first direction and thus are swept-forward shaped. In the swept-forward fan set, the area of the orthographic projection on the center plane of the blade arranged in the back in the second direction is less than the area of the orthographic projection on the center plane of the blade arranged at the front in the second direction.

In view of the foregoing, in the axial flow fan provided by the disclosure, an airflow may pass through the first negative pressure surface, the second positive pressure surface, and the positive pressure side in sequence from the negative pressure side, so that possibility of generation of a separation flow at the first negative pressure surface is accordingly reduced, and noise may also be lowered. Further, the airflow may pass through the second negative pressure surface, the third positive pressure surface, and the positive pressure side in sequence from the negative pressure side, so that possibility of generation of a separation flow at the second negative pressure surface is accordingly reduced, and noise may also be lowered.

Therefore, the airfoil design of the fan sets may be used to replace the single-blade design provided by a conventional axial flow fan, and in this way, generation of a separation flow in the axial flow fan may be reduced, so that the axial flow fan is prevented from stalling during rotation.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An axial flow fan, comprising:

a hub, configured to rotate around a center axis and having a negative pressure side and a positive pressure side opposite to each other; and a plurality of fan sets, disposed around the hub, wherein each of the fan sets comprises at least two blades, and each of the at least two blades has a wind inlet end, a wind outlet end opposite to the wind inlet end, a negative pressure surface, and a positive pressure surface opposite to the negative pressure surface in each of the fan sets, wherein a minimum distance between the wind inlet end of one of the adjacent at least two blades and the positive pressure side is greater than a minimum distance between the wind inlet end of the other one of the adjacent at least two blades and the positive pressure side, a minimum distance between the wind outlet end of one of the adjacent at least two blades and the negative pressure side is less than a minimum distance between the wind outlet end of the other one of the adjacent at least two blades and the negative pressure side, the wind outlet end of one of the adjacent at least two blades corresponds to the wind inlet end of the other one of the adjacent at least two blades, the negative pressure surface of one of the adjacent at least two blades corresponds to the positive pressure surface of the other one of the adjacent at least two blades, and a gap is provided between the negative pressure surface of one of the adjacent at least two blades and the positive pressure surface of the other one of the adjacent at least two blades, wherein curvatures of the negative pressure surfaces of the at least two blades decrease as the distances between wind inlet ends of the at least two blades and the positive pressure side decrease in each of the fan sets.

2. The axial flow fan as claimed in claim 1, wherein the wind inlet end of each of the at least two blades is connected between the positive pressure surface and the negative pressure surface and the wind outlet end of each of the at least two blades is connected between the positive pressure surface and the negative pressure surface in each of the fan sets, the negative pressure surface of each of the at least two blades is relatively close to the negative pressure side, the positive pressure surface of each of the at least two blades is relatively close to the positive pressure side, and the minimum distance between the wind inlet end of each of the at least two blades and the positive pressure side is greater than a minimum distance between the wind outlet end of each of the at least two blades and the positive pressure side.

3. The axial flow fan as claimed in claim 1, wherein a curvature of the negative pressure surface of one of the adjacent at least two blades is greater than a curvature of the negative pressure surface of the other one of the adjacent at least two blades in each of the fan sets.

4. The axial flow fan as claimed in claim 1, wherein curvatures of the negative pressure surfaces of the at least two blades are different from each other in each of the fan sets.

5. The axial flow fan as claimed in claim 1, wherein a material of the at least two blades comprises metal.

6. The axial flow fan as claimed in claim 1, wherein each of the at least two blades has a uniform thickness or a non-uniform thickness.

7. The axial flow fan as claimed in claim 1, wherein orthographic projection of the at least two blades on any plane perpendicular to the center axis do not overlap with each other in each of the fan sets.

8. The axial flow fan as claimed in claim 1, wherein a tangent line is defined by a limit of the negative pressure surface of one of the at least two blades close to the wind inlet end and the other tangent line is defined by a limit of the negative pressure surface of the other one of the at least two blades in each of the fan sets, wherein a slope of the other tangent line is greater than a slope of the tangent line.

9. The axial flow fan as claimed in claim 1, wherein a first tangent line is defined by a limit of the negative pressure surface of each of the at least two blades close to the wind inlet end and a second tangent line is defined by a limit of the negative pressure surface of each of the at least two blades close to the wind outlet end in each of the fan sets, wherein a slope of the second tangent line is greater than a slope of the first tangent line.

10. The axial flow fan as claimed in claim 1, wherein the hub rotates around the center axis in a first direction, each of the at least two blades is bent in a second direction, and the first direction is opposite to the second direction.

11. The axial flow fan as claimed in claim 10, wherein the at least two blades are arranged in the second direction from one of the adjacent at least two blades to the other one of the adjacent at least two blades in each of the fan sets.

12. The axial flow fan as claimed in claim 11, wherein an area of orthographic projection of the other one of the adjacent at least two blades on any plane perpendicular to the center axis is greater than an area of orthographic projection of one of the adjacent at least two blades on any plane perpendicular to the center axis.

13. The axial flow fan as claimed in claim 1, wherein each of the fan sets comprises:

a first blade, connected to the hub, having a first wind inlet end, a first negative pressure surface, a first wind outlet end, and a first positive pressure surface connected in sequence;

a second blade, connected to the hub, having a second wind inlet end, a second negative pressure surface, a second wind outlet end, and a second positive pressure surface connected in sequence;

a third blade, connected to the hub, having a third wind inlet end, a third negative pressure surface, a third wind outlet end, and a third positive pressure surface connected in sequence, wherein a first minimum distance between the first wind inlet end and the positive pressure side is greater than a second minimum distance between the second wind inlet end and the positive pressure side, the second minimum distance between the second wind inlet end and the positive pressure side is greater than a third minimum distance between the third wind inlet end and the positive pressure side, a fourth minimum distance between the first wind outlet end and the negative pressure side is less than a fifth minimum distance between the second wind outlet end and the negative pressure side, the fifth minimum distance between the second wind outlet end and the negative pressure side is less than a sixth minimum distance between the third wind outlet end and the negative pressure side, the first wind outlet end corresponds to the second wind inlet end, the second wind outlet end corresponds to the third wind inlet end, the first negative pressure surface corresponds to the second positive pressure surface, a first gap is provided between the first negative pressure surface and the second positive pressure surface, the second negative pressure surface corresponds to the third positive pressure surface, and a second gap is provided between the second negative pressure surface and the third positive pressure surface.

14. The axial flow fan as claimed in claim 13, wherein the first negative pressure surface, the second negative pressure surface, and the third negative pressure surface are relatively close to the negative pressure side, the first positive pressure surface, the second positive pressure surface, and the third positive pressure surface are relatively close to the positive pressure side, the first minimum distance between the first wind inlet end and the positive pressure side is greater than a seventh minimum distance between the first wind outlet end and the positive pressure side, the second minimum distance between the second wind inlet end and the positive pressure side is greater than an eighth minimum distance between the second wind outlet end and the positive pressure side, and the third minimum distance between the third wind inlet end and the positive pressure side is greater than a ninth minimum distance between the third wind outlet end and the positive pressure side.

15. The axial flow fan as claimed in claim 13, wherein a center plane is defined at a middle of the negative pressure side and the positive pressure side of the hub, the first blade is close to the negative pressure side, the second blade crosses the center plane, and the third blade is close to the positive pressure side.

16. The axial flow fan as claimed in claim 13, wherein a first negative pressure point is defined at connection between the first wind inlet end and the first negative pressure surface, a second negative pressure point is defined at connection between the second wind inlet end and the second negative pressure surface, a third negative pressure point is defined at connection between the third wind inlet end and the third negative pressure surface, a fourth negative pressure point is defined at connection between the third wind outlet end and the third negative pressure surface, a first positive pressure point is defined at connection between the first wind inlet end and the first positive pressure surface, a second positive pressure point is defined at connection between the first wind outlet end and the first positive pressure surface, a third positive pressure point is defined at connection between the second wind outlet end and the second positive pressure surface, and a fourth positive pressure point is defined at connection between the third wind outlet end and the third positive pressure surface, wherein a first connection line is defined among the first negative pressure point, the second negative pressure point, the third negative pressure point, and the fourth negative pressure point, a second connection line is defined between the fourth negative pressure point and the fourth positive pressure point, a third connection line is defined among the first positive pressure point, the second positive pressure point, the third positive pressure point, and the fourth positive pressure point, a fourth connection line is defined between the first negative pressure point and the first positive pressure point, and an airfoil is surrounded and formed by the first connection line, the second connection line, the third connection line, and the fourth connection line.

* * * * *